US006324763B1

(12) United States Patent
Lee

(10) Patent No.: US 6,324,763 B1
(45) Date of Patent: Dec. 4, 2001

(54) STRUCTURE ART DESIGN KNIFE

(76) Inventor: Tai-Wang Lee, 7F-4, No.187, Jung Shiau Road, Taichung City (TW)

( * ) Notice: Subject to any disclaimer, the term of this patent is extended or adjusted under 35 U.S.C. 154(b) by 0 days.

(21) Appl. No.: 09/545,501

(22) Filed: Apr. 7, 2000

(51) Int. Cl.[7] ..... B26B 1/08
(52) U.S. Cl. ..... 30/162; 30/125; 30/335
(58) Field of Search ..... 30/162, 151, 329, 30/335, 125

(56) References Cited

U.S. PATENT DOCUMENTS

| | | | | |
|---|---|---|---|---|
| 3,577,637 | * | 5/1971 | Braginetz | 30/162 |
| 3,765,089 | * | 10/1973 | Ibata | 30/162 |
| 4,242,795 | * | 1/1981 | Rollband et al. | 30/162 |
| 5,121,544 | * | 6/1992 | Gilbert | 30/162 |
| 5,406,707 | * | 4/1995 | Owens et al. | 30/162 |
| 6,161,290 | * | 12/2000 | Takamasa | 30/162 |
| 6,163,963 | * | 12/2000 | Huang | 30/162 |
| 6,192,589 | * | 2/2001 | Martone et al. | 30/125 |

* cited by examiner

*Primary Examiner*—Hwei-Siu Payer

(74) *Attorney, Agent, or Firm*—Dougherty & Troxell

(57) ABSTRACT

An improved structure art design knife comprised of a lower cover, a front upper cover, a rear upper cover, a blade mount, a blade, a release button, and a press button. The blade mount for the blade is contained in the blade mount channel of the lower cover, with a guide slot and a number of stepped engagement notches also disposed on the lower cover. A semicircular hole is formed at the other end of the lower cover, with a tab having a hook slot situated nearby. Formed in the front upper cover that fits onto the front end of the lower cover is an elongated hole having inserted within a retention button and a retention block, and the inner side of the retention block is tapered. Formed at the back end of the rear upper cover is another semicircular hole that corresponds to the semicircular hole of the lower cover. Two insertion nocks are formed along the center of the back side of blade. By utilizing these components when the present invention is utilized for cutting, it is only necessary to push the retention button forward to check the leftward and rightward movement of the blade and pushing the release button to the right causes the release block of the release button to also move rightward against the retaining element of the blade mount, releasing the retaining element from the insertion nocks of the blade and allowing the easy replacement of the blade.

3 Claims, 8 Drawing Sheets

STRUCTURE ART DESIGN KNIFE

BACKGROUND OF THE INVENTION

1) Field of the Invention

The invention herein relates to an improved structure art design knife that is easy to control during cutting operations.

2) Description of the Prior Art

Conventional art design knives are capable of cutting or slicing paper or twine of average thickness. For thicker cardboard or overlaid carded material, a larger model art design knife such as that shown in FIG. 1 is required to facilitate cutting. However, when cutting with the blade 1 of such an art design knife, the blade 1 tends to wiggle because a clearance interval is required between the blade 1 and the guide slot 2, which causes curvilinear drift or deviation from the intended line while cutting that requires additional corrective trimming or, in the case of serious inaccuracy, renders objects discardable. How to provide for very easy control and less skewing propensity is now the key objective requirement that must be achieved and in view of the said shortcomings and their causes, the inventor of the invention herein designed the present invention utilizing simple components.

SUMMARY OF THE INVENTION

The primary objective of the invention herein is to provide an improved structure art design knife that is convenient to operate and control that does not curvilinearly drift or deviate from the intended line while utilized for cutting to prevent additional corrective trimming or serious inaccuracy that renders objects discardable, and thereby reduce defect rates.

Another objective of the invention herein is to provide an improved structure art design knife wherein blade replacement is extremely easy, rapid, and safe and, furthermore, does not require any additional tools to accomplish.

DETAILED DESCRIPTION OF THE PREFERRED EMBODIMENTS

Figure 1:
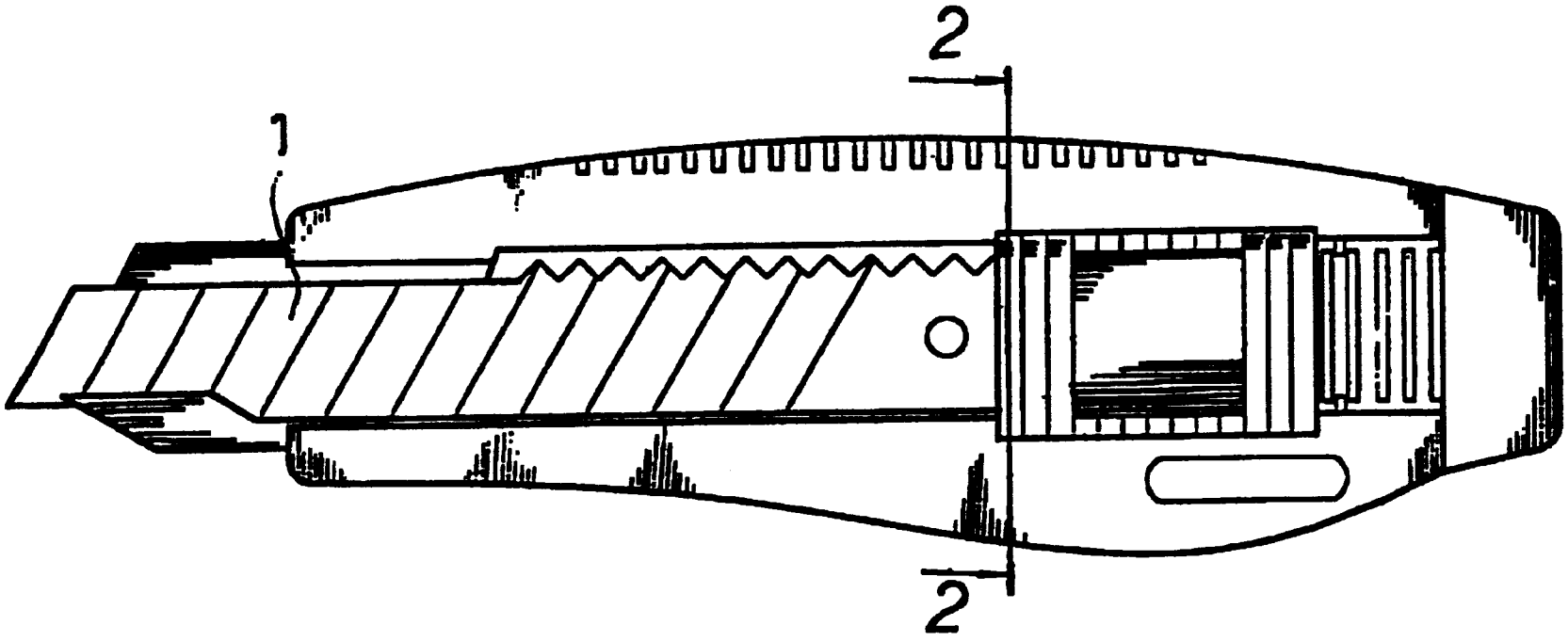
FIG1 PRIOR ART
FIG. 1 is an orthographic drawing of a conventional art design knife.
Figure 2:
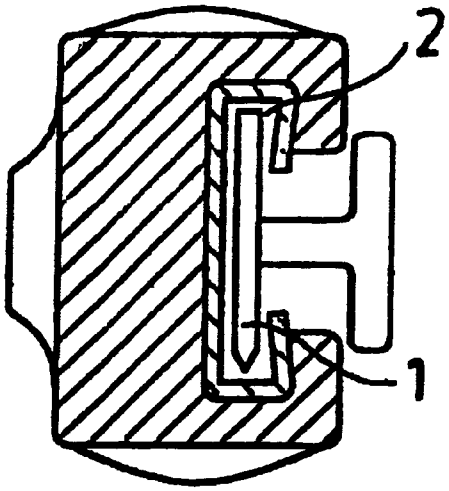
FIG2 PRIOR ART
FIG. 2 is a cross-sectional drawing of FIG. 1 as viewed from the perspective of line 2—2.
Figure 3:
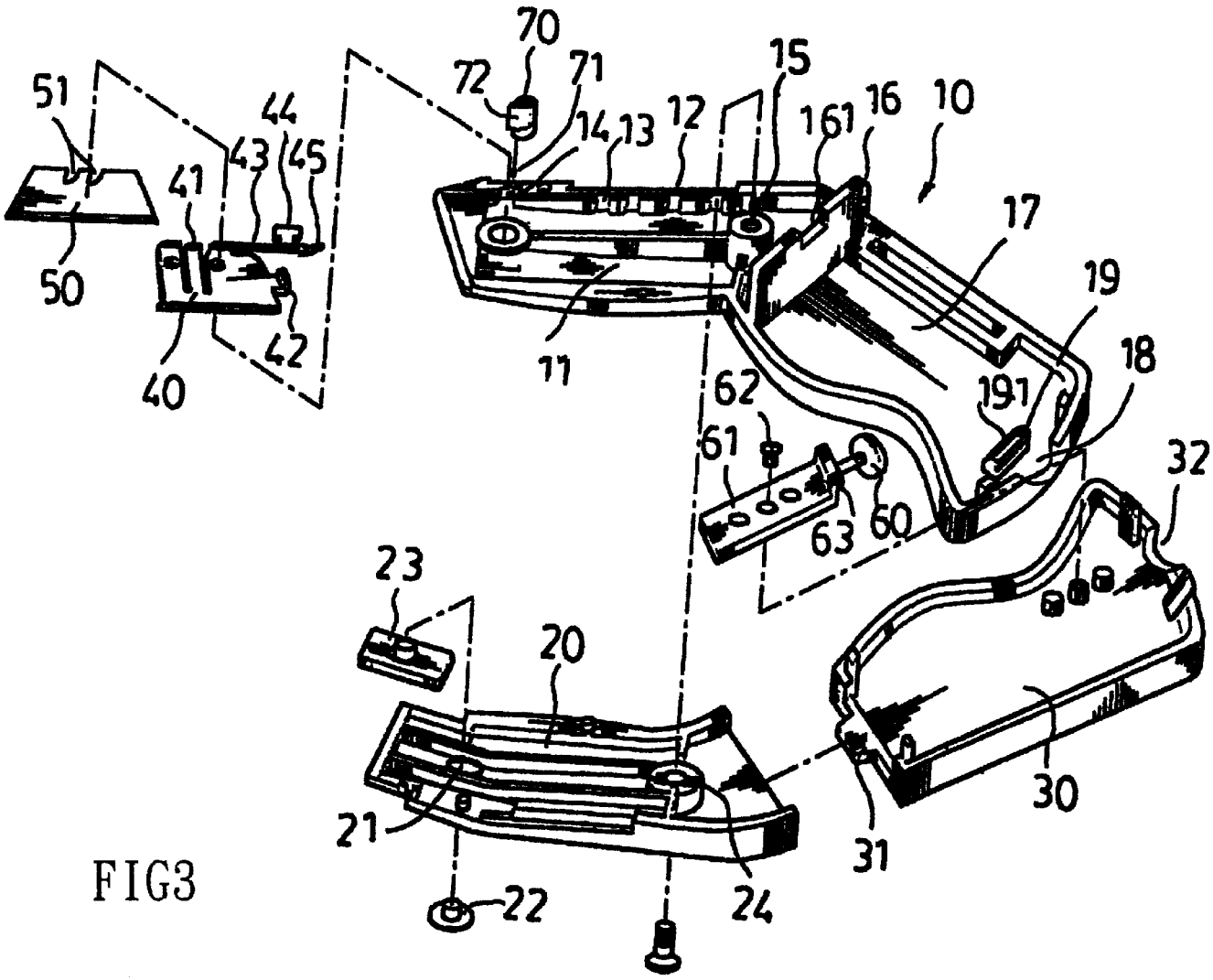
FIG. 3 is an exploded drawing of the most preferred embodiment of the invention herein.

Referring to FIG. 3, FIG. 4, FIG. 5, FIG. 6, FIG. 7, and FIG. 8, the invention herein is comprised of:

A lower cover 10 having a design in which the thicker rear end is gradually diminished in dimension towards the front and, furthermore, is of a curved L-shaped profile (as shown in FIG. 3); a blade mount guide channel 11 is formed along the center of the said lower cover 10, with a blade mount 40 for the blade 50 contained in the said channel; formed at the upper exterior side of the lower cover 10 a guide slot 12 having a number of stepped engagement notches 13 disposed along its facing inner sides, with a detent notch 14 formed at the front end of the engagement notches 13; additionally, a screw hole 15 is formed in the center of the curve and a partition element 16 projects from one side, with a mortise 161 formed in the partition element 16; storage compartment 17 is situated next to the partition element 15 for the placement of a number of blades 50 and other articles; and a semicircular hole 18 is formed at the other end of the lower cover 10, with a tab 19 having a hook slot 191 situated nearby.

A front upper cover 20 that fits onto the front end of the lower cover 10, and formed in the exterior lateral surface of the front end of the front upper cover 20 is an elongated hole 21 having inserted within a retention button 22 and a retention block 23; the taper of the inner side of the retention block 23 corresponds to the taper of the upper front cover 20; the retention block 23 is positionally aligned with the blade mount 40, the retention block 23 and the retention button 22 in the said elongated hole 21 are aligned, and the screw hole 15 of the lower cover 10 is aligned with a through-hole 24 in the said front upper cover 20, thereby enabling the said front upper cover 20 and the lower cover 10 to be assembled into a unitary structure by means a fastening bolt.

A rear upper cover 30 that fits onto the rear end of the lower cover 10, and situated at the front end of the rear upper cover 30 is a tenon 31 that is inserted into the mortise 161 in the lower cover 10 to form a unitary body, with a semicircular hole 32 formed at the very end that corresponds to the semicircular hole 18 of the lower cover 10 and thereby yields a circular hole upon conjoinment.

A blade mount 40 constructed of a thin sheet of contoured metal that has a retaining element 41 formed from angular bends at its upper extent and a limiter element 42 protruding in an erect manner from one side such that the retaining element 41 and the limiter element 42 are capable of securing a blade 50 in the blade mount 40, and projecting from the upper end is an extender/retractor button 44 of an extension element 43, with the extender/retractor button 44 reaching into and capable of forward and backward movement inside the guide slot 12 of the said lower cover 10 and, furthermore, a positioning element 45 of relatively wider width is situated at the tail end of the said extension element 43 to extend and thereby expose the length of the blade 50 in the engagement notches 13.

A blade 50 of a thin trapezoidal shape having forward and rear cutting edges capable of interchangeable utilization as well as two insertion notches 51 formed along the center of the back side such that when a blade 50 is placed into the blade mount 40, the retaining element 41 is engaged into the insertion notches 51.

A press button 60 that is inserted into the circular hole resulting from the conjoinment of the semicircular holes 18 and 32 of the lower cover 10 and the rear upper cover 30, respectively, and has at the interior side an L-shaped push plate 61; a fastening screw 62 secures the longer end of the push plate 61 to an appropriate position on the inner side of the rear upper cover 30 and a hook 63 is formed at the end that fits into the hook slot 191 of the tab 19, enabling the assembly of the rear upper cover 30 to the lower cover 10.

A release button 70 that is inserted into the detent notch 14 of said lower cover 10 and, furthermore, a spring 71 is installed in between the release button 70 and the detent notch 14, and a release block 72 protrudes from the outer side of the release button 70.

Figure 4:
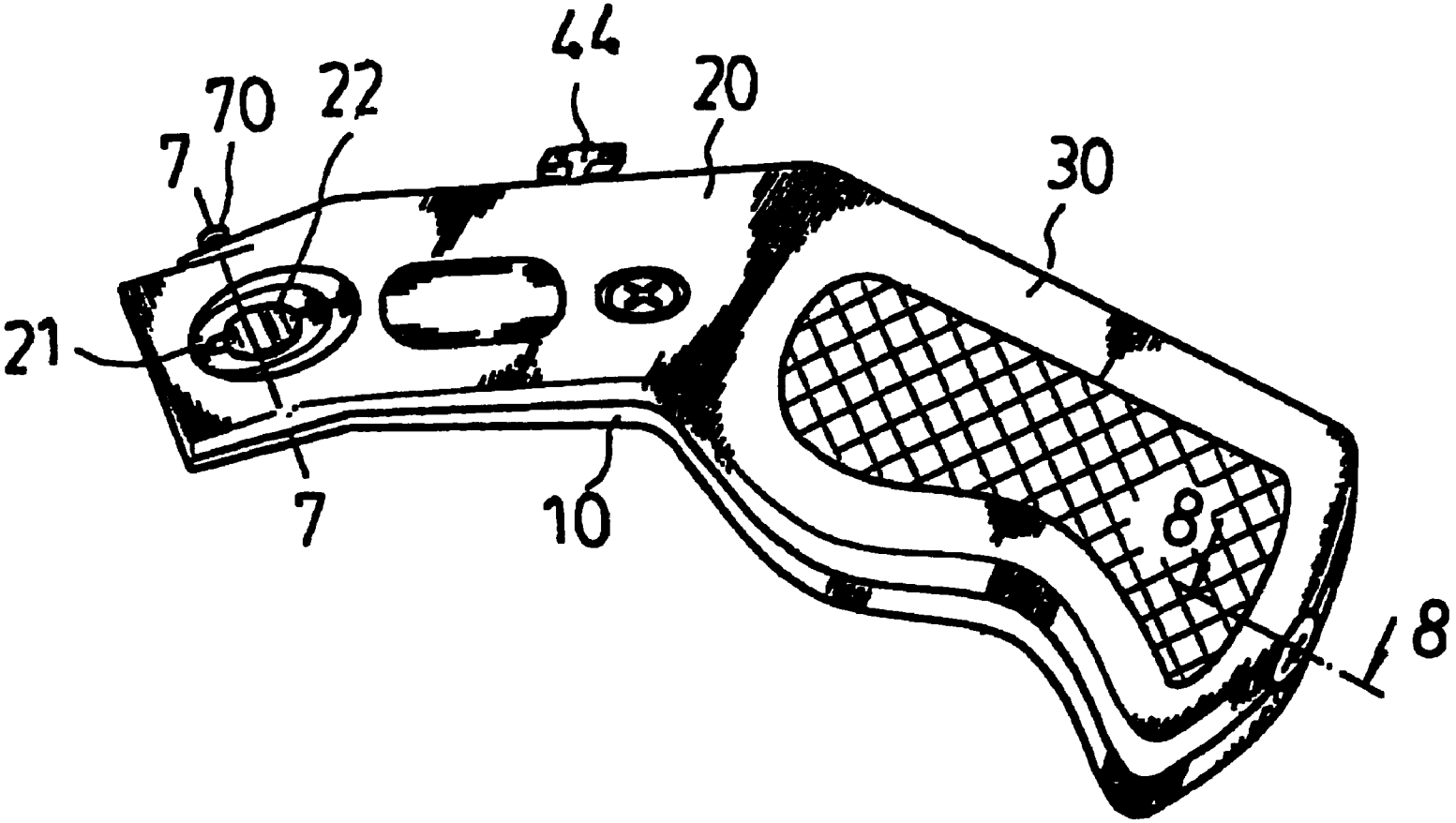
FIG. 4 is an isometric drawing of the most preferred embodiment of the invention herein.
Figure 5:
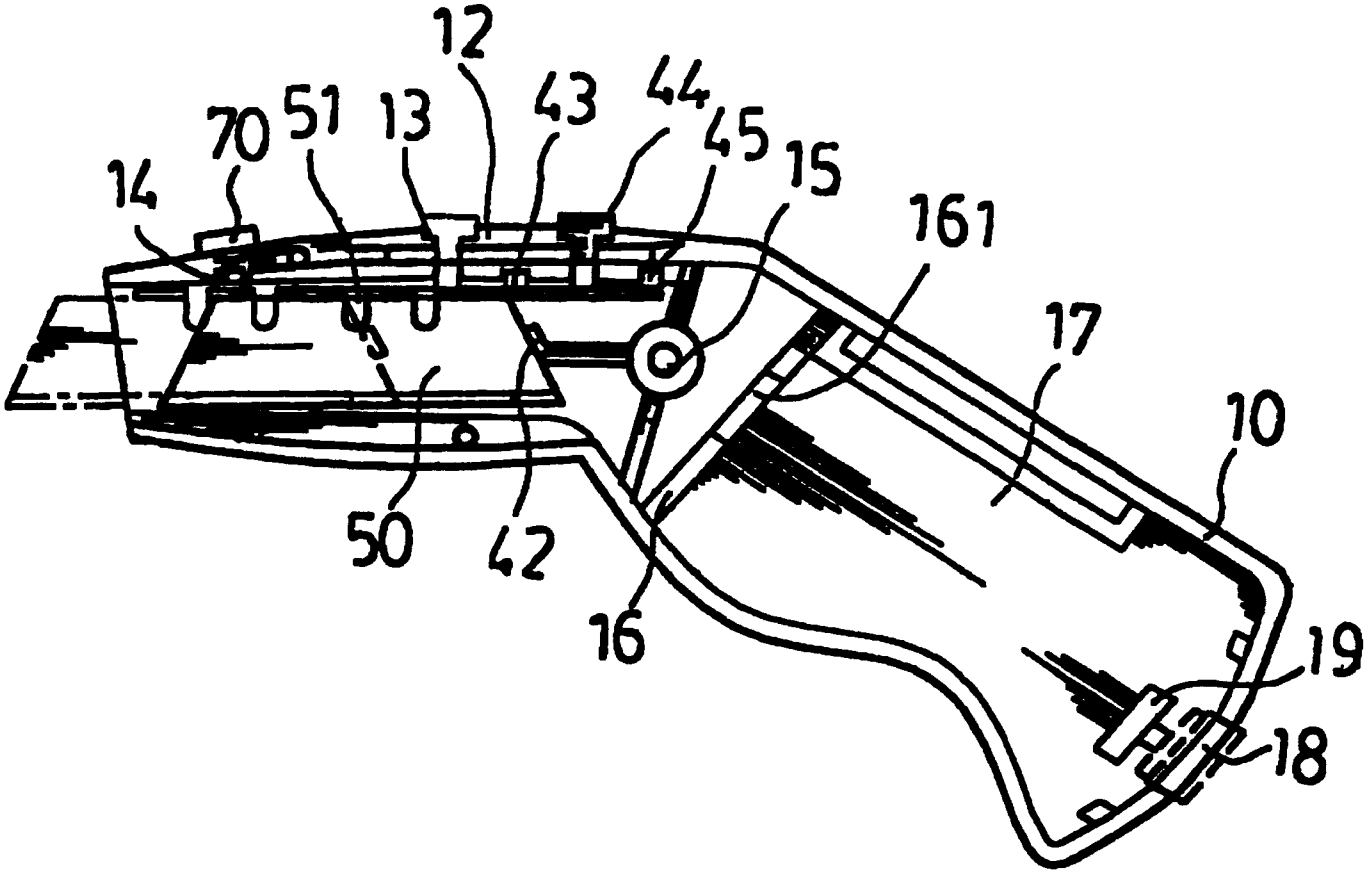
FIG. 5 is an orthographic drawing of the invention herein without the first and second covers.
Figure 6:
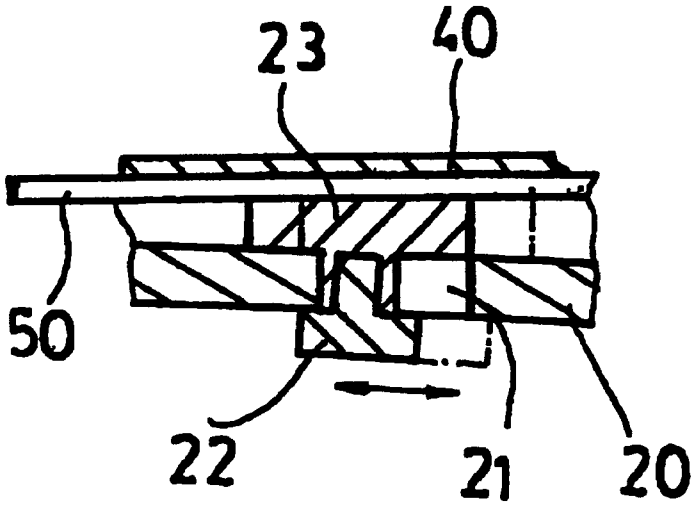
FIG. 6 is a cross-sectional drawing of the invention herein illustrating the operation of the retention button.

To assemble the components shown in FIG. 3 into the embodiment of the invention herein depicted in FIG. 4, a blade 50 is placed into the blade mount 40 and then the blade mount 40 is installed into the blade mount guide channel 11 in the lower cover 10 and, furthermore, the release button 70 is installed into the detent notch 14 of the said lower cover 10, thereby causing the release block 72 of the release button 70 to become positionally aligned with the retaining element 41 of the blade mount 40; the retention block 23 and the retention button 22 are positioned in the elongated hole 21, the front upper cover 20 is fastened onto the lower cover 10, then the push plate 61 is secured to the rear upper cover 30, and finally the tenon 31 of the rear upper cover 30 is inserted into the mortise 161 of the lower cover 10, and the hook 63 of the press button 60 is engaged into the hook slot 191 of the tab 19, thereby enabling the assembly of the lower cover 10 to the front upper cover 20 and the rear upper cover 30 to form a unitary physical entity.

To utilize the invention herein for cutting, it is only necessary to press down on the extender/retractor button 44 of the blade mount 40 and thereby disengage the positioning element 45 of the blade mount 40 from the engagement notches 13 of the lower cover 10, and push the extender/retractor button 44 forward to move the blade 50 outside the invention herein, and then release the extender/retractor button 44 to allow the positioning element 45 of the blade mount 40 to re-engage the engagement notches 13 at a new location; then, the retention button 22 is pushed forward and, since the retention block 23 of the retention button 22 is tapered and the front upper cover 20 has a corresponding taper, when the retention button 22 is pushed forward, it exerts pressure against the lateral surface of the blade 50 to eliminate the interval between the blade 50 and the lower cover 10 to check the leftward and rightward movement of the blade 50 for control against curvilinear drift or deviation from the intended line while cutting and thereby preventing additional corrective trimming or serious inaccuracy that renders objects discardable.

To retract the blade 50 of the invention herein, it is only necessary to execute the said operation in reverse order by pulling back the retention button 22 and thereby releasing pressure against the lateral surface of the blade 50. Then, drawing back and thus opening the extender/retractor button 44 to return the blade 50 inward to prevent the occurrence of hazardous accidents.

Figure 7:
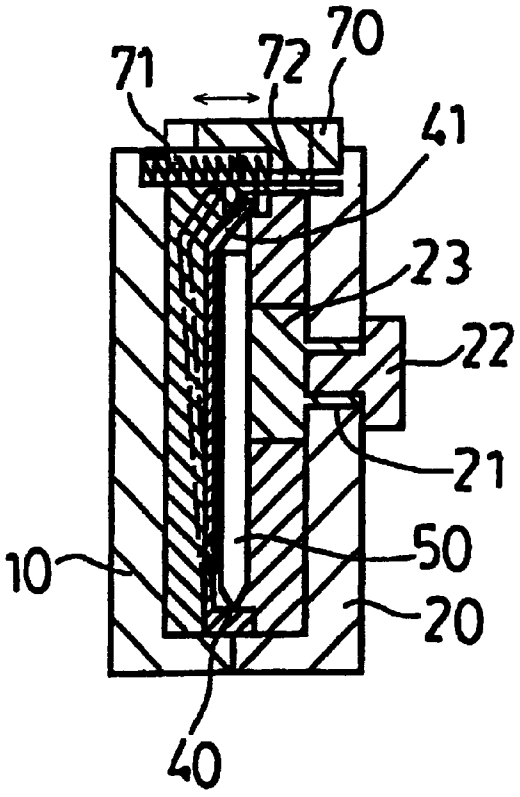
FIG. 7 is a cross-sectional drawing of the invention herein illustrating the operation of the release button as viewed from the perspective of line 7—7 in FIG. 4.
Figure 8:
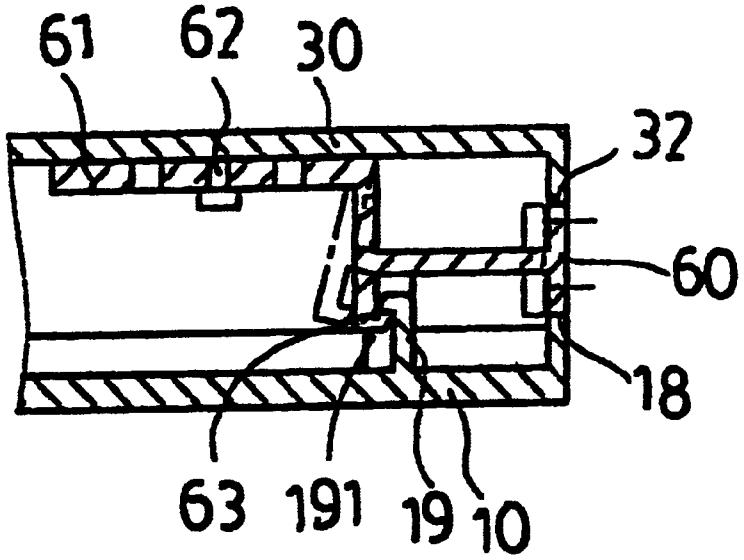
FIG. 8 is a cross-sectional drawing of the invention herein illustrating the operation of the release button as viewed from the perspective of line 8—8 in FIG. 4.

As the blade 50 of the invention herein gradually become dulled due to repeated cutting, the blade 50 can be turned around to enable the usage of a different blade tip—in the case of multiple application blades—or the remaining fresh cutting edge of the same blade 50 by pushing the release button 70 to the right, thereby causing the release block 72 of the said release button 70 to separate from the retaining element 41 of the blade mount 40, whereupon the said retaining element 41 is disengaged from the insertion notches 51 of the blade 50 and allows the blade 50 to be pulled out and slid back into the blade mount 40 to utilize a different application blade or the unused slicing edge of the blade 50 and, furthermore, the release button 70 in its opened state allows the retaining element 41 to re-engage the insertion notches 51 of the blade 50 and as such, the invention herein does not have to be disassembled to remove and exchange the blade 50 (as shown in FIG. 7).

When spare blades 50 and other articles are extricated from the storage compartment 17 in the said lower cover 10, it is only necessary to push down the press button 60 and thereby causing the push plate 61 to act as a lever such that the hook 63 of the push plate 61 is disengaged from the hook slot 191 of the lower cover 10, allowing the separation of the lower cover 10 and the rear upper cover 30 for accessing blades 50 and other articles; then, the rear upper cover 30 is reinstalled and, furthermore, the hook 63 of the push plate 61 once again engages the hook slot 191 of the lower cover 10 to restore assembly.

As such, the invention herein is of a simple structure in which assembly, disassembly, and blade replacement is convenient, rapid, and safe and, furthermore, is equipped with a control surface that enables cutting ease and does not curvilinearly drift or deviate from the intended line while cutting, preventing additional corrective trimming or serious inaccuracy that renders objects discardable and thereby reduces defect rates.

In summation of the foregoing section, since the present invention is based on sound concepts and possess advantageous industrial value, the invention herein is lawfully submitted to the patent bureau in application for review and the granting of the commensurate patent rights.

What is claimed is:

1. An improved art design knife comprised of a first cover, a front second cover, a rear second cover, a blade mount, a blade, a release button, and a press button, wherein:

the first cover has a thickness which gradually diminishes from a back towards a front and has a curved L-shaped profile; a guide channel is formed along a center of a front portion of the first cover, the blade mount mounting the blade in the guide channel; a guide slot formed at an upper exterior side of the first cover and having a number of stepped engagement notches disposed along facing inner sides, with a detent notch formed at a front end of the guide slot; a partition element projecting from the first cover with a mortise formed therein; a rear portion of the first cover adjacent to the partition element forming a storage compartment for a placement of a plurality of extra blades; and a first semicircular hole formed at the rear portion of the first cover with a tab having a hook slot adjacent thereto;

the front second cover mounted onto the front portion of the first cover, and having an exterior lateral surface with an elongated hole, the front second cover having a tapered section, the front second cover mounted to the first cover by means of a fastening bolt;

a retention button mounted on a retention block having a taper on an inner side corresponding to and in contact with the tapered section of the front second cover such that when pushed forward, pressure is exerted against a lateral surface of the blade, thereby eliminating a clearance between the blade and the first cover;

a rear second cover mounted onto the rear portion of the first cover having a tenon inserted into the mortise in the partition element, and a second semicircular hole aligned with the first semicircular hole of the first cover and a push plate and a hook mounted on a rear end of the rear second cover;

the release button is inserted into the detent notch of said first cover and a spring is installed between said release button and the detent notch, a release block protruding from an outer side of the release button to separate a retaining element blade mount to facilitate replacement of the blade, whereby pushing the retention button forward exerts pressure against a lateral surface of the blade to eliminate the clearance between the blade and the first cover to prevent lateral movement of the blade while cutting: and pushing the release button causes the release block to separate from the retaining element of the blade mount, whereupon the retaining element is disengaged from the blade to permit replacement of the blade.

2. The improved art design knife of claim 1 wherein the press button is placed into a circular hole resulting from the conjoinment of the first and second semicircular holes of the first cover and the rear second cover, and has at an interior side thereof an L-shaped push plate with a fastening screw securing the push plate to an inner side of the rear second cover such that the hook fits into the hook slot of the tab, thereby connecting the rear second cover to the first cover, whereby pushing the press button causes the hook to be disengaged from the hook slot, allowing the separation of the first cover and the rear second cover.

3. The improved art design knife of claim 1 wherein the blade mount has a retaining element formed thereon as well as a limiter element protruding from one side such that the retaining element and the limiter element secure the blade in the blade mount.

* * * * *